United States Patent [19]

Yoshida et al.

[11] 4,388,903

[45] Jun. 21, 1983

[54] DEVICE FOR CONTROLLING AIR-FUEL RATIO FOR INTERNAL COMBUSTION ENGINES

[75] Inventors: Seietsu Yoshida; Masao Ito, both of Kariya; Yukio Kawai, Toyota; Toshihisa Ogawa, Aichi, all of Japan

[73] Assignees: Nippondenso Co., Ltd., Kariya; Toyota Jidosha Kogyo K.K., Toyota, both of Japan

[21] Appl. No.: 251,127

[22] Filed: Apr. 6, 1981

[30] Foreign Application Priority Data

Apr. 7, 1980 [JP] Japan ..... 55-44706

[51] Int. Cl.[3] ..... F02B 33/00; F02M 7/00

[52] U.S. Cl. ..... 123/440; 123/339; 123/437

[58] Field of Search ..... 123/436, 437, 440, 339, 123/493, 320

[56] References Cited

U.S. PATENT DOCUMENTS

| | | | |
|---|---|---|---|
| 4,240,390 | 12/1980 | Takeda | 123/440 |
| 4,241,710 | 12/1980 | Peterson, Jr. et al. | 123/440 |
| 4,252,098 | 2/1981 | Temczak et al. | 123/437 |
| 4,305,360 | 12/1981 | Meyer et al. | 123/339 |

*Primary Examiner*—Raymond A. Nelli

*Attorney, Agent, or Firm*—Kenyon & Kenyon

[57] ABSTRACT

A device for controlling air-fuel ratio for an internal combustion engine with a use of the signal from an oxygen sensor adjacent to a three-way catalytic converter, the device comprising throttle sensor for detecting the transient running state of the engine and supplying the detected signal to a controller, integration by an integration circuit in the controller being commenced at a predetermined value produced in an initial voltage setting circuit in the controller, regardless of the preceding value of the output of the integration circuit, in such a transient state as a sudden deceleration.

15 Claims, 6 Drawing Figures

(I) OUTPUT OF THROT. SENSOR 31
(II) OUTPUT OF O2 SENSOR 6
(III) OUTPUT OF R/L DISCRIMN. 81
(IV) INPUTS FOR COMPAR. 847
(VII) OUTPUT OF CAPACITOR 841
(VIII) OUTPUT OF COMPAR. 847
Vt
"1"
"0"
1
0
"1"
"0"
VP1
VP
Vt
VP2
0
0
"1"
"0"
TIME

DEVICE FOR CONTROLLING AIR-FUEL RATIO FOR INTERNAL COMBUSTION ENGINES

BACKGROUND OF THE INVENTION

The present invention relates to systems for controlling the air-fuel ratio for an internal combustion engine, particularly an internal combustion engine for motor cars.

A feedback device for controlling the air-fuel ratio of an internal combustion engine by using a signal from an oxygen sensor ($O_2$ sensor) which is located adjacent to a three-way catalytic converter in the exhaust system has been known. The feedback control is carried out in such a manner that the amount of air which enters a carburetor is controlled, or the amount of fuel or air which enters the intake manifold of the engine is controlled. In either case, when the oxygen sensor produces a "RICH" signal, the control is carried out so as to make the air-fuel ratio "LEAN", and when the oxygen sensor produces a "LEAN" signal, the control is carried out so as to make the air-fuel ratio "RICH". Thus the air-fuel ratio is controlled to a desired value, and hence the three-way catalytic converter is operated in a range where high cleaning efficiency can be achieved.

However, the above-described, known method creates a problem which is best explained with reference to the wave forms illustrated in FIG. 1. That is, when the running state of the engine changes at $t_1$ from the high power state to the idle state, the actual air supply to the intake manifold of the engine changes along the SLOPE-1 in waveform (IV) of FIG. 1, but the air supply which is actually required by the engine is expressed in waveform the broken line SLOPE-2 in (IV) of FIG. 1. This results from the fact that the control voltage $V_f$ produced in the feedback control device changes rather slowly in accordance with the integration characteristic of the feedback control device. Accordingly, the resulting condition of excessive air supply may cause a situation wherein the ignition of the air-fuel mixture by engine is not carried out so that the engine stalls or surges.

It is, therefore, an object of this invention to provide an improved device for controlling the air-fuel ratio for an internal combustion engine which is not subject to the foregoing and other problems in the prior art.

SUMMARY OF THE INVENTION

In accordance with the embodiments of the present invention, the control of the air-fuel ratio is achieved with reference to the signal from the oxygen sensor. The control of the air-fuel ratio is carried out satisfactorily during both, the steady state and transient state modes of operation of the car, so that the occurrence of engine stall or surging is prevented. In accordance with the present invention, the control during the transient state is carried out without deteriorating the control characteristic during the steady state, because the rate of change of the control value, for example, the control voltage ($V_f$), is not significantly increased.

In accordance with the present invention there is provided a device for controlling the air-fuel ratio of an air-fuel mixture supplied to an internal combustion engine, the device being provided with means for regulating the air-fuel ratio of the air-fuel mixture in response to a control signal; an oxygen sensor for sensing the oxygen concentration in the exhaust gases of the engine and producing an oxygen signal indicative of the oxygen concentration; a transient sensor for detecting the transient running state including the idle state of the engine and producing a transient signal, and; an electronic controller for receiving the signal from the oxygen sensor and the transient sensor and supplying the control signal to an air-fuel ratio regulating means. The electronic controller includes an integrating means for effecting integration in response to the oxygen signal from the oxygen sensor, and an initial voltage setting means for operating in response to said transient signal, changing the output signal of the integrating means quickly to a predetermined value and causing the integrating means to commence the integration from the predetermined value.

DETAILED DESCRIPTION

Figure 1:
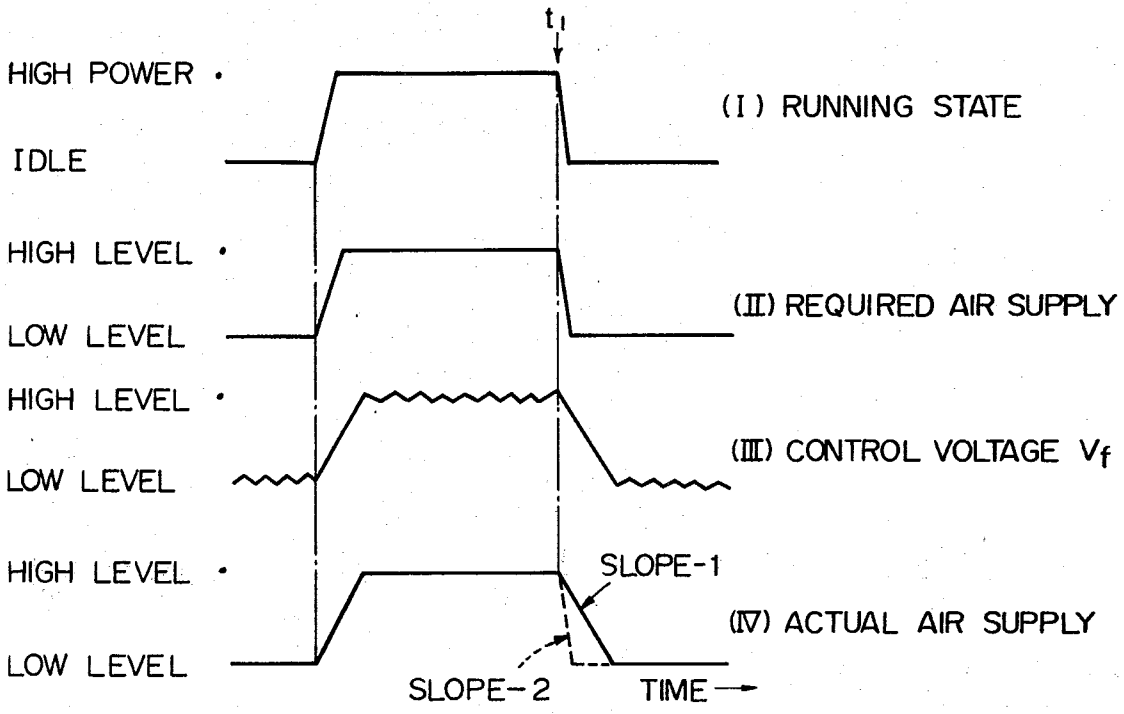
FIG. 1 illustrates wave forms of the signals appearing in a prior art device for controlling the air-fuel ratio for an internal combustion engine.
Figure 2:
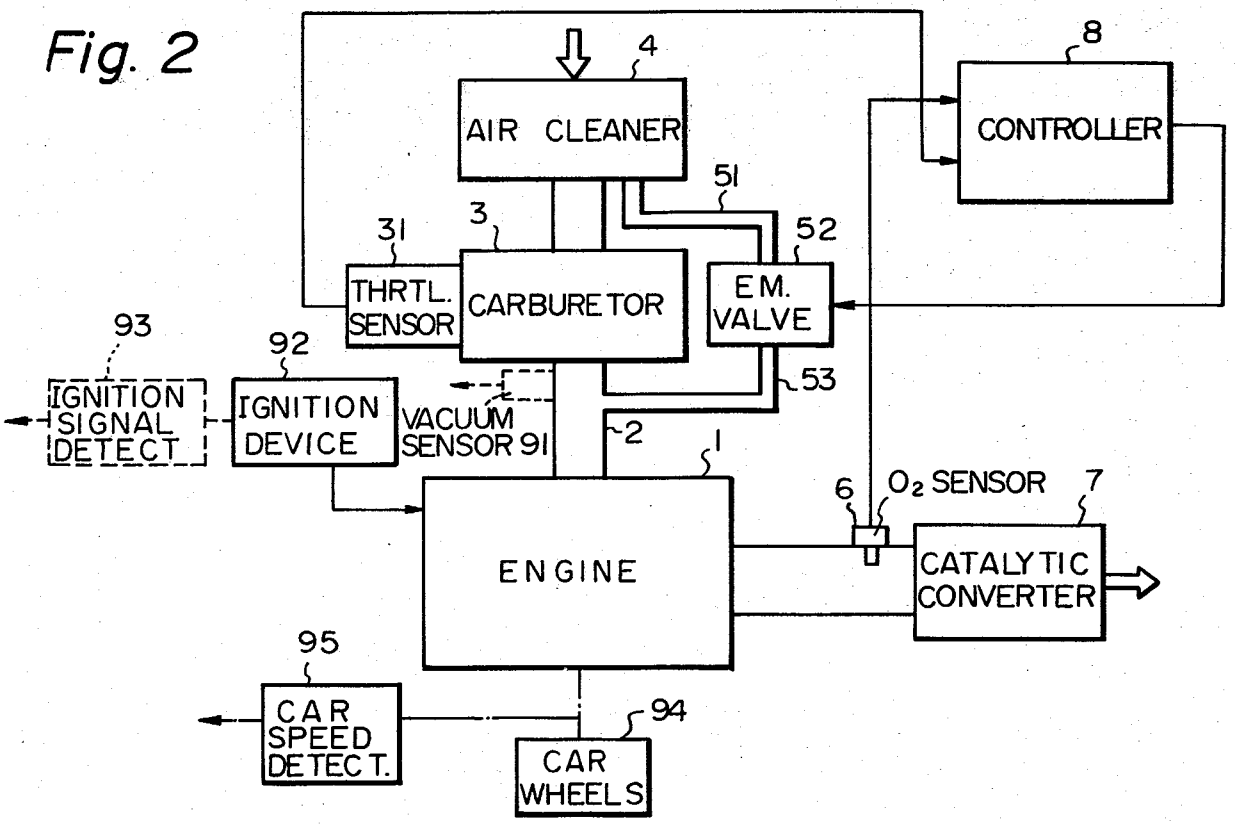
FIG. 2 illustrates a device for controlling the air-fuel ratio for an internal combustion engine in accordance with an embodiment of the present invention.
Figure 3:
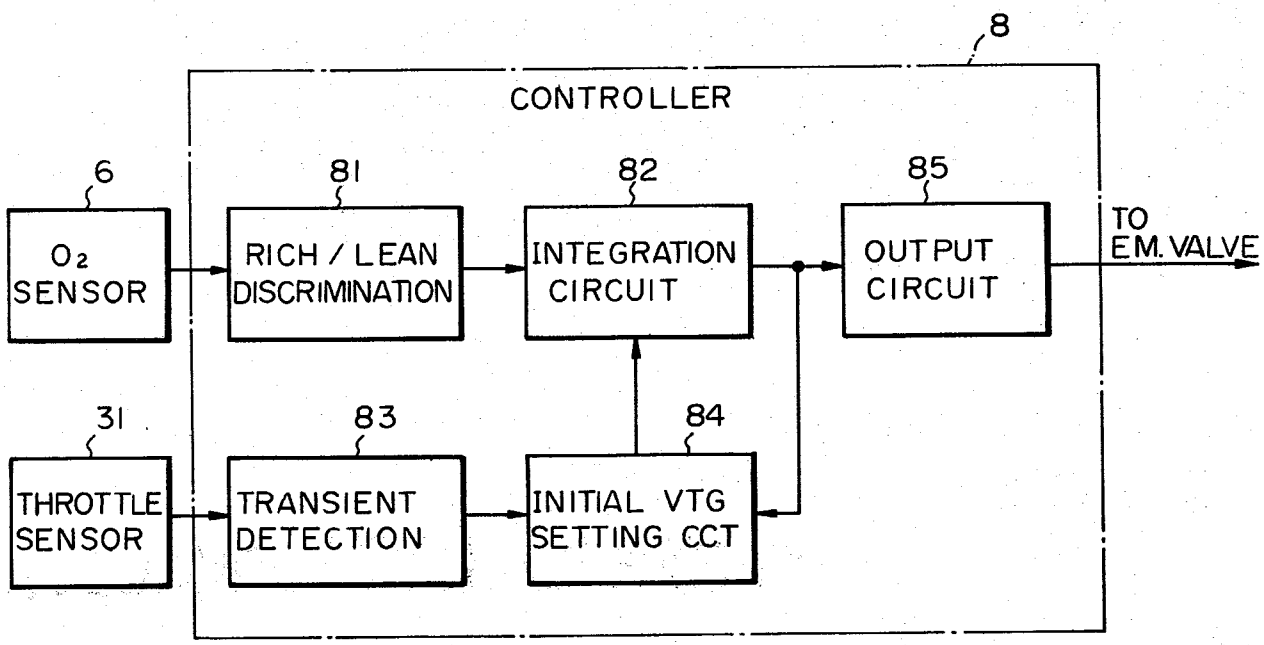
FIG. 3 illustrates the functional structure of the controller in the device of FIG. 2.
Figure 4:
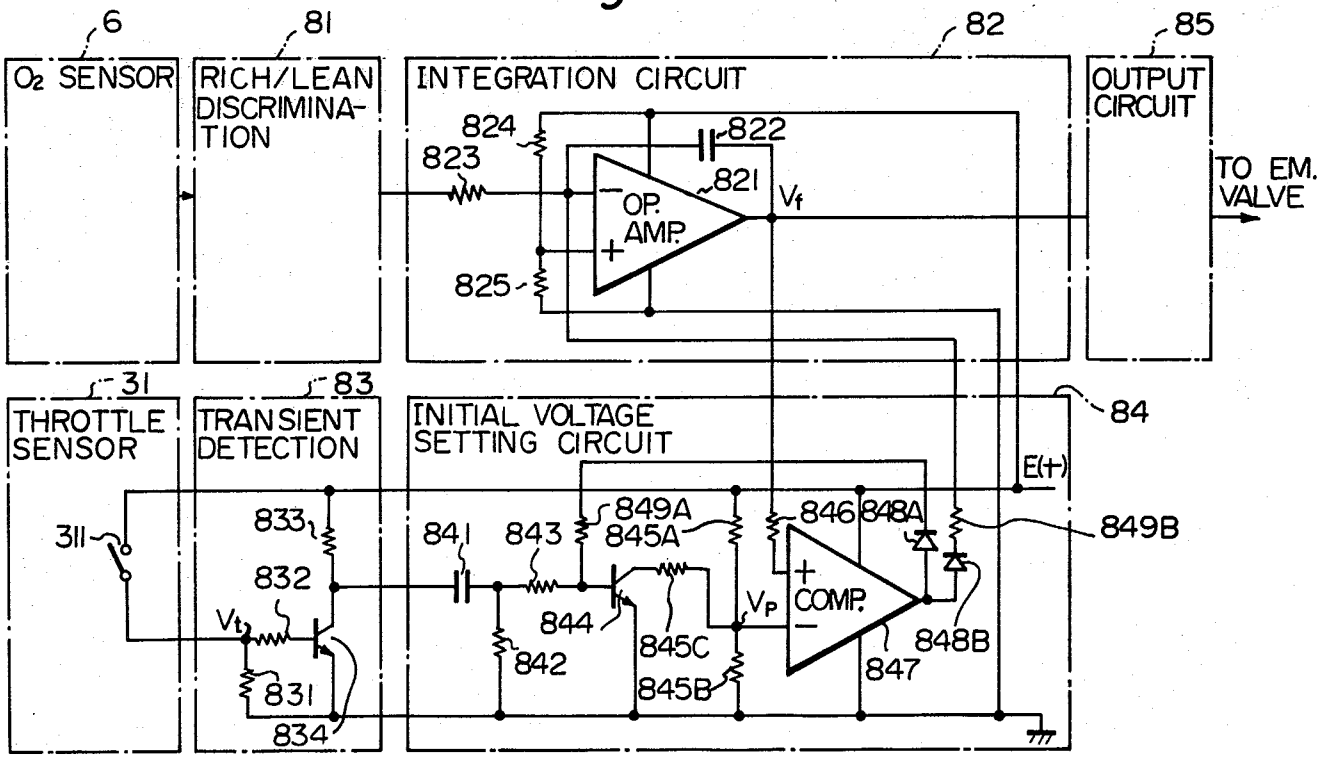
FIG. 4 illustrates the circuit diagram of the controller in the device of FIG. 2.

An air-fuel ratio controlling device in accordance with an embodiment of the present invention is illustrated in FIG. 2. The structure of a portion of the device of FIG. 2 is illustrated in FIGS. 3 and 4. The device of FIG. 2 is utilized with an internal combustion engine 1 having an intake path 2 located between the engine 1 and a throttle valve of a carburetor 3. The device is provided with a throttle sensor 31, an air cleaner 4, additional air flow paths 51 and 53, an electromagnetic valve 52, an $O_2$ sensor 6, a three-way catalytic converter 7 and an electronic controller 8. The throttle sensor 31 detects the angle of the throttle of the carburetor 3.

The output signal of the throttle sensor 31 and the output signal of the $O_2$ sensor 6 are supplied to the input terminals of the controller 8. The output signal of the controller 8 is supplied to the electromagnetic valve 52 to regulate the additional air flow from the air cleaner 4 through air flow paths 51 and 53 to the intake path 2. The electromagnetic valve 52 comprises a linear solenoid valve which regulates continuously the air flow. Also, in FIG. 2, a vacuum sensor 91, an ignition device 92, an ignition signal detecting device 93, car wheels 94 and a car speed detecting device 95 are illustrated by function blocks.

The fundamental structure of the controller 8 is illustrated in FIG. 3. The controller 8 comprises a circuit 81 for discriminating RICH/LEAN of the signal from $O_2$ sensor 6, a circuit 83 for detecting transient on the basis of the signal from the throttle sensor 31, a circuit 82 for integrating the signal from the circuit 81, a circuit 84 for setting the initial voltage on the basis of the signals from the circuits 83 and 82, and an output circuit 85 from which the signal for the electromagnetic valve 52 is derived. The details of the RICH/LEAN discrimination circuit 81 is well known to a skilled person and, therefore, is not described herein.

The details of the circuit of the controller 8 are illustrated in FIG. 4. The integration circuit 82 comprises an operational amplifier 821, a capacitor 822, and resistors 823, 824 and 825. The transient detection circuit 83 comprises a transistor 834 and resistors 831, 832 and 833. The initial voltage setting circuit 84 comprises a capacitor 841, resistors 842, 843, a transistor 844, resistors 845A, 845B, 845C, a resistor 846, a comparator 847, diodes 848A, 848B and resistors 849A, 849B.

The output terminal of the $O_2$ sensor 6 is connected to the input terminal of the RICH/LEAN discriminating circuit 81, the output signal of which is supplied to the integration circuit 82. A reference voltage determined by the voltage divider resistors 824 and 825 is supplied to the non-inverting input terminal of the operational amplifier 821. A capacitor 822 is connected between the inverting input terminal and the output terminal of the operational amplifier 821. A resistor 823 which determines the value of the charging current of the capacitor 822 is connected the output terminal of the RICH/LEAN discriminating circuit 81 and the inverting input terminal of the operational amplifier 821. The output signal $V_f$ of the operational amplifier 821 is supplied to the output circuit 85 which regulates the electromagnetic valve 52 which controls the air flow through the paths 51 and 53.

The throttle sensor 31 consists of a switch 311. When the throttle valve in the carburetor is closed in the idle state of the engine, the switch 311 is in OFF state and accordingly the value of the output signal $V_t$ is "0" level. While, when the throttle valve is not closed the switch 311 is in ON state and accordingly the value of the output signal $V_t$ is "1" level. In the transient detecting circuit 83, the reversal and the waveform shaping of the signal $V_t$ is carried out. The output signal of the transient detecting circuit 83 is supplied to the initial voltage setting circuit 84. The differentiation of the signal is carried out by the capacitor 841. At the connecting point between the resistors 845A, 845B and 845C, the reference voltage $V_p$ is obtained which is supplied to one of the input terminals of the comparator 847. When the transistor 844 is in ON state, the reference voltage $V_p$ attains the value $V_{p2}$ which will be explained hereinafter as the initial value. While, when the transistor 844 is in OFF state, the reference voltage $V_p$ attains the value $V_{p1}$ which is greater than the maximum value of $V_f$. The output signal $V_f$ of the integration circuit 82 is supplied to the other input terminal of the comparator 847 through the resistor 846. The comparator 847 compares the values of two input signals. The comparator 847 produces the output signal "1" when $V_f$ is greater than $V_p$, and produces the output signal "0" when $V_p$ is greater than $V_f$. Only while the output signal of the comparator 847 is "1", a current is supplied through the diode 848A and the resistor 849A to the base of the transistor 844 to render said transistor 844 to be ON, and a current is supplied through the diode 848B and the resistor 849B to the inverting input terminal of the operational amplifier 821.

Figure 5:
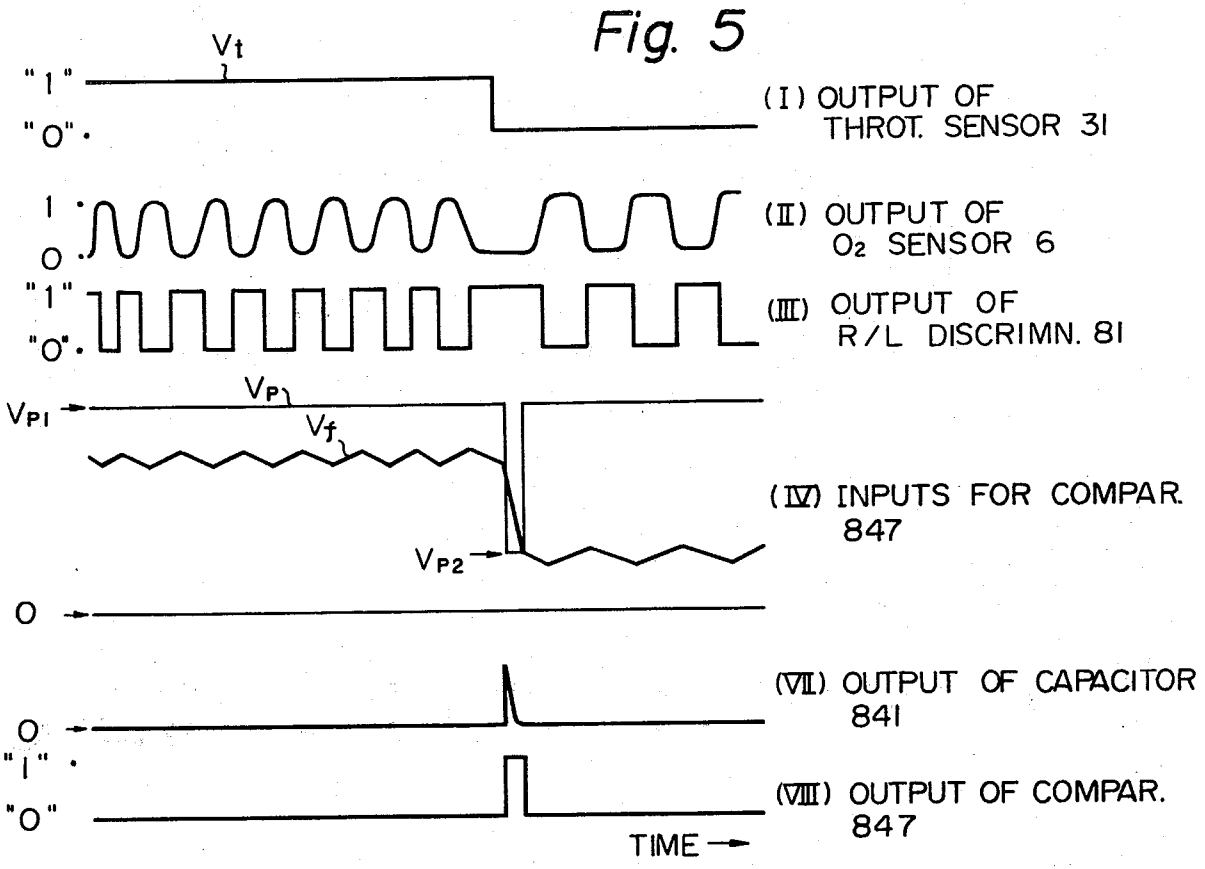
FIG. 5 illustrates wave forms of signals present at the respective portions of the circuit of FIG. 4.

The waveforms of the signals at the portions of the circuit of FIG. 4 are illustrated in FIG. 5. The output signal of the throttle sensor 31, the output signal of the $O_2$ sensor 6, the output signal of the RICH/LEAN discrimination circuit 81, the input signals for the comparator 847, the output signal of the capacitor 841 and the comparator 847 are illustrated.

The operation of the circuit of FIG. 4 will now be described with reference to the wave forms of FIG. 5.

Steady State Running

When the car is in steady state running, the output signal of the throttle sensor 31 is "1" level state. The output voltage of the $O_2$ sensor 6 oscillates between 1 and 0, as illustrated in (II) of FIG. 5. Accordingly, the RICH/LEAN discriminating circuit 81 produces the output signal having the wave form as illustrated in (III), and hence the integration circuit 82 produces the output signal $V_f$ having the wave form as illustrated in (IV). Under this condition, since the transistor 844 is in OFF state, the value of the reference voltage $V_p$ is greater than that of the maximum value of $V_f$, and hence the comparator 847 produces the output signal "0" level. The voltage $V_p$ presumes the value $V_{p1}$ as expressed in equation (1) below.

$$V_{p1} = \frac{R(845B)}{R(845B) + R(845A)} \cdot E \qquad (1)$$

In equation (1), R(845B) and R(845A) are the resistances of the resistors 845B and 845A, and E is the power source voltage.

Sudden Deceleration

When the car is suddenly decelerated, the output of the throttle sensor 31 falls down to "0", as illustrated in (I) of FIG. 5.

At this moment, the capacitor 841 produces a differentiated pulse as illustrated in (VII) of FIG. 5 which causes the transistor 844 to become momentarily in the ON state. Accordingly, the reference voltage $V_p$ falls down to the value $V_{p2}$ as expressed in equation (2) below, where R(845C) is the resistance of the resistor 845C.

$$V_{p2} = \frac{R(845B) \cdot R(845C)}{R(845A) \cdot R(845B) + R(845B) \cdot R(845C) + R(845C) \cdot R(845A)} \cdot E \qquad (2)$$

Under this condition, the comparator 847 produces the output signal "1" during a period where the voltage $V_f$ is greater than $V_{p2}$, and accordingly, a current passes through the diode 848A, the resistor 849A and the base of the transistor 844 so that the ON state of the transistor 844 is maintained. At the same time, a quick charging current to the capacitor 822 of the integration circuit 82 flows through the diode 848B and the resistor 849B, and hence the voltage $V_f$ is reduced quickly. When the voltage $V_f$ becomes less than $V_p$, the output of the comparator 847 is reversed to produce the signal "0", and hence neither current fed to the base of the transistor 844 nor current for charging the capacitor 822 of the integration circuit 82 flows anymore. At this moment, the differential signal at the output of the capacitor 841 has attained the value "0", and hence the transistor 844 has become in the OFF state, and accordingly the voltage $V_p$ has attained a value greater than the maximum value of $V_f$. After that, a new phase of the feedback control by the controller 8 is carried out with the value $V_{p2}$ as the initial value of $V_p$, in accordance with the output signal of the $O_2$ sensor 6.

It will be understood that a relatively long time elapses until the new phase of the feedback control commences if the voltage $V_f$ is relatively large, while only a relatively short time elapses until the new phase of the feedback control commences if the voltage $V_f$ is relatively small.

In the above described embodiment the throttle sensor 31 is used as means for detecting the transient state of the car running. However, in the modified embodiments, a vacuum sensor 91 provided at the intake path 2, an ignition signal detector 93 associated with an ignition device 92 of the engine, or a car speed detector 95 can be used as means for detecting the transient state of the car running.

Figure 6:
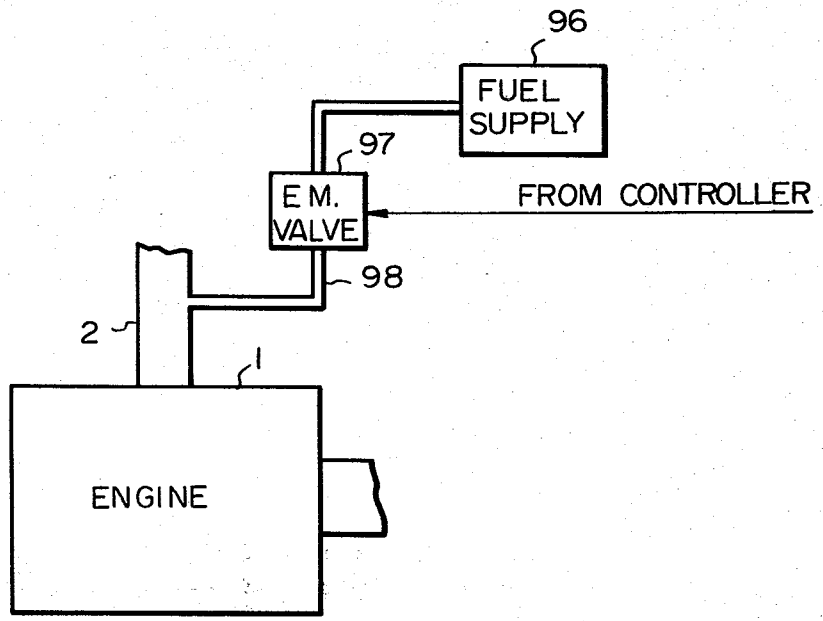
FIG. 6 illustrates another embodiment of means for controlling the air-fuel ratio for the device of FIG. 2.

Although in the above described embodiment the air-fuel ratio control of the engine is carried out by controlling the supply of air to the intake path 2 of the engine, it is also possible to carry out the air-fuel ratio control of the engine by controlling the feeding of fuel from a fuel supplying device 96 by means of a valve 97 in a fuel path 98 connected with the intake path 2 of the engine as illustrated in FIG. 6. However, in this alternative embodiment the constitution of the RICH/LEAN discrimination circuit should be changed to effect the reverse operation of that of the RICH/LEAN discrimination circuit 81 of FIG. 3.

It is to be understood that, although the invention has been described in terms of specific embodiments and applications, persons skilled in the art, in light of this teaching, can generate additional embodiments without departing from the spirit or exceeding the scope of the claimed invention. Accordingly, the drawings and descriptions in this disclosure are proffered merely to facilitate comprehension of the invention and should not be construed to limit the scope thereof.

We claim:

1. A device for controlling the air-fuel ratio of an air-fuel mixture supplied to an internal combustion engine, comprising:

air-fuel ratio regulating means for regulating the air-fuel ratio of the air-fuel mixture in response to a control signal;

an oxygen sensor for sensing the oxygen concentration in the exhaust gases of the engine and producing an oxygen signal indicative of the oxygen concentration;

a transient sensor for detecting a transient running state of the engine and producing a transient detection signal indicative of said transient running state, and;

an electronic controller for receiving said oxygen signal from said oxygen sensor and said transient detection signal from said transient sensor and supplying said control signal to said air-fuel ratio regulating means;

said electronic controller including an integrating means for effecting integration in response to the signal from said oxygen sensor and an initial setting means for operating, independently of said oxygen signal from said oxygen sensor, in response to said transient detection signal, changing the output signal of said integrating means quickly to a predetermined value, and causing said integrating means to commence the integration from said predetermined value.

2. A device as defined in claim 1, wherein said initial setting means includes a comparator and a reference voltage means for supplying a reference voltage ($V_p$) to said comparator, and said reference voltage means reduces said reference voltage ($V_p$) to a predetermined value ($V_{p2}$) after a switching to the transient running state of said engine.

3. A device as defined in claim 2, wherein said reference voltage means reduces said reference voltage ($V_p$) only during the time said comparator is producing the signal "1".

4. A device as defined in claim 1, wherein said transient sensor includes a throttle sensor for sensing a closed position of a throttle valve of the engine.

5. A device as defined in claim 1, wherein said transient sensor includes a vacuum sensor for sensing the intake vacuum of said engine.

6. A device as defined in claim 1, wherein said transient sensor includes an ignition signal detector associated with an ignition device of said engine.

7. A device as defined in claim 1, wherein said transient sensor includes a car speed detector.

8. A device as defined in claim 1, wherein said air-fuel ratio regulating means for regulating the air-fuel ratio at the intake path of said engine is a valve for regulating additional air flow from an air cleaner to the engine.

9. A device as defined in claim 1, wherein said air-fuel ratio regulating means for regulating the air-fuel ratio at the intake path of said engine is a valve for regulating additional fuel flow from a fuel supplying device to the engine.

10. A device as defined in claim 2, wherein said initial setting means includes a capacitor for producing a differentiated signal by differentiating said transient detection signal, and said reference voltage means triggers to reduce said reference voltage ($V_p$) in response to said differentiated signal produced by said capacitor.

11. A device as defined in claim 2, wherein said reference voltage means includes voltage divider resistors and a transistor for generating said reference voltage ($V_p$) and said reference voltage means provides two different values of said reference voltage ($V_p$) in accordance with the OFF or ON states of said transistor.

12. A device as defined in claim 11, wherein said initial setting means includes a diode and a resistor for connecting the output of said comparator to the base of said transistor, and the base current of said transistor is supplied from the output of said comparator through said diode and said resistor.

13. A device as defined in claim 2, wherein said integrating means includes an operational amplifier and a capacitor connected between the input and output terminals of said operational amplifier, and said initial setting means charges quickly said capacitor, independently of said oxygen signal from said oxygen sensor, in response to said transient detection signal, to bring the output voltage of said integrating means to a predetermined voltage ($V_f$).

14. A device as defined in claim 13, wherein voltage divider resistors are connected to the non-inverting input terminal of said operational amplifier, and a reference voltage determined by said voltage divider resistors is supplied to said non-inverting input terminal of said operational amplifier.

15. An air-fuel ratio control system for an internal combustion engine having a throttle valve, comprising:

means for regulating the air-fuel ratio of the air-fuel mixture in response to a control signal;

an oxygen sensor for sensing the oxygen concentration in the exhaust gases of the engine and producing an oxygen signal indicative of the oxygen concentration;

deceleration detection means for detecting a sudden deceleration state where the throttle valve becomes substantially completely closed and producing the signal indicative of the sudden deceleration;

an electronic controller for receiving the signal from said oxygen sensor and said transient sensor and supplying the control signal to said air-fuel ratio regulation means;

said electronic controller carrying out integration in response to the signal from said oxygen sensor, changing quickly the value of the integration, independently of the signal from said oxygen sensor, to a predetermined value in response to the deceleration signal, and commencing the integration from said predetermined value.

* * * * *